US009022501B2

(12) United States Patent
Takeishi

(10) Patent No.: US 9,022,501 B2
(45) Date of Patent: May 5, 2015

(54) METHOD AND APPARATUS FOR PRINTING

(71) Applicant: Canon Kabushiki Kaisha, Tokyo (JP)

(72) Inventor: Takahide Takeishi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/919,461

(22) Filed: Jun. 17, 2013

(65) Prior Publication Data

US 2014/0002525 A1 Jan. 2, 2014

(30) Foreign Application Priority Data

Jun. 28, 2012 (JP) ..... 2012-145308

(51) Int. Cl.

| | |
|---|---|
| ***B41J 29/38*** | (2006.01) |
| ***B41J 2/07*** | (2006.01) |
| ***B41J 2/21*** | (2006.01) |
| *B41J 2/165* | (2006.01) |

(52) U.S. Cl.

CPC *B41J 2/07* (2013.01); *B41J 2/2142* (2013.01); *B41J 2/2146* (2013.01); *B41J 2002/16573* (2013.01)

(58) Field of Classification Search

CPC .... B41J 2/0458; B41J 2/04563; B41J 29/393; B41J 2/04591; B41J 2/04581

See application file for complete search history.

(56) References Cited

U.S. PATENT DOCUMENTS

| | | | | |
|---|---|---|---|---|
| 5,850,237 | A * | 12/1998 | Slade | 347/23 |
| 7,628,466 | B2 * | 12/2009 | Cellura et al. | 347/19 |
| 8,029,091 | B2 | 10/2011 | Kato | |
| 2009/0167801 | A1 * | 7/2009 | Kato | 347/14 |
| 2011/0211003 | A1 * | 9/2011 | Kusakabe | 347/14 |
| 2011/0279508 | A1 | 11/2011 | Naito | |
| 2013/0088541 | A1 | 4/2013 | Naito | |

FOREIGN PATENT DOCUMENTS

JP 2011-240492 A 12/2011

OTHER PUBLICATIONS

Office Action issued in Chinese Patent Application No. 201310269102.9 dated Oct. 28, 2014.

* cited by examiner

*Primary Examiner* — Manish S Shah
*Assistant Examiner* — Jeremy Delozier
(74) *Attorney, Agent, or Firm* — Fitzpatrick, Cella, Harper & Scinto

(57) ABSTRACT

A method for printing on a continuous sheet with an inkjet head includes printing a plurality of images in sequence and performing plural kinds of maintenance operations by using intermediate areas located between one of the images and next one of the images in accordance with a schedule, and setting the schedule such that a first maintenance operation included in the plural kinds of maintenance operations and a second maintenance operation which is performed with frequency different from that of the first maintenance operation are not performed at the same intermediate area.

15 Claims, 11 Drawing Sheets

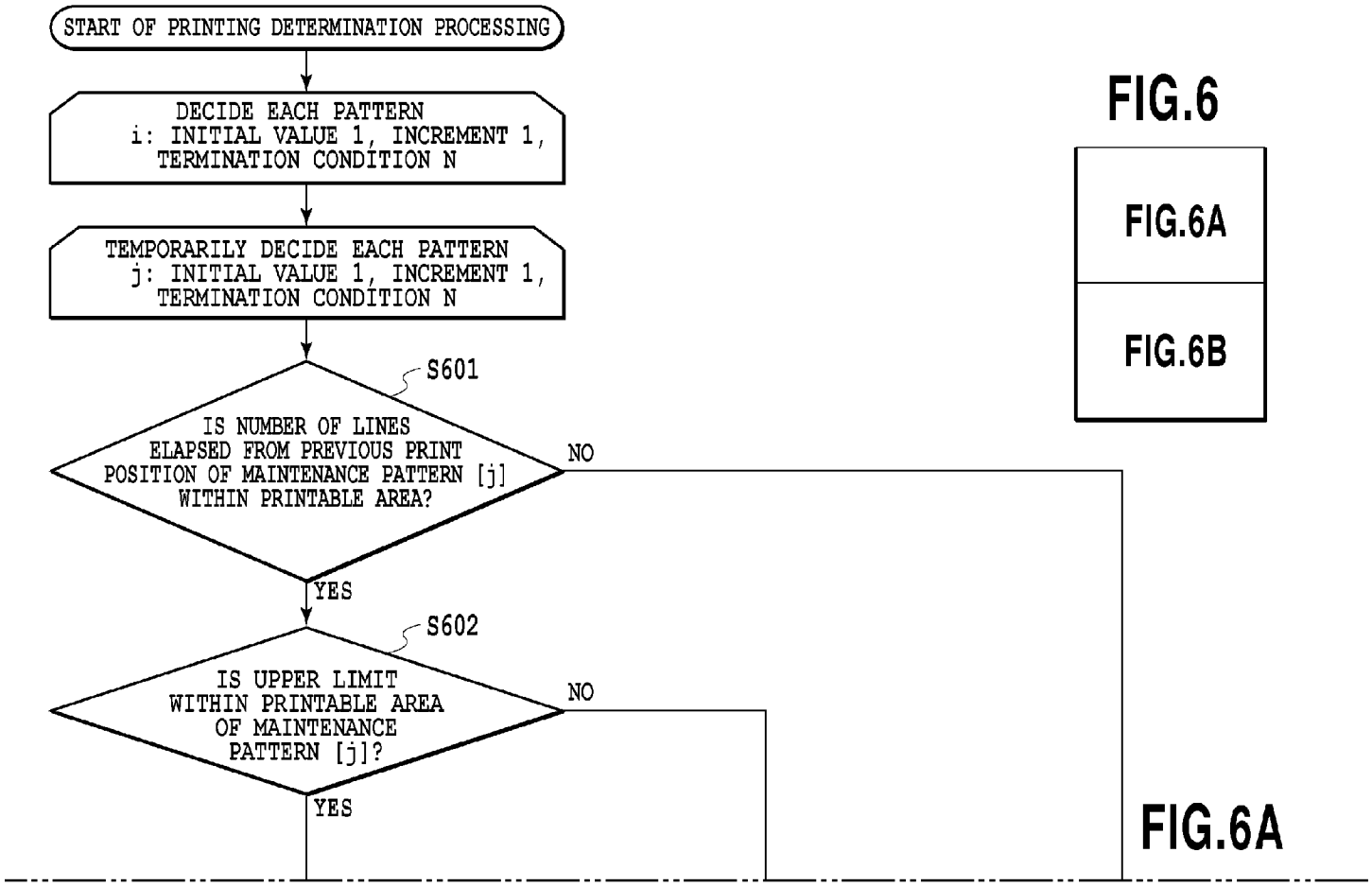
START OF PRINTING DETERMINATION PROCESSING
DECIDE EACH PATTERN
i: INITIAL VALUE 1, INCREMENT 1,
TERMINATION CONDITION N
TEMPORARILY DECIDE EACH PATTERN
j: INITIAL VALUE 1, INCREMENT 1,
TERMINATION CONDITION N
S601
IS NUMBER OF LINES
ELAPSED FROM PREVIOUS PRINT
POSITION OF MAINTENANCE PATTERN [j]
WITHIN PRINTABLE AREA?
NO
YES
S602
IS UPPER LIMIT
WITHIN PRINTABLE AREA
OF MAINTENANCE
PATTERN [j]?
NO
YES
FIG.6
FIG.6A
FIG.6B
FIG.6A

| | PRIORITY ORDER | NUMBER OF LINES | DETERMINATION RESULT (BEFORE UPDATING RESULT) | DETERMINATION RESULT (AFTER UPDATING RESULT) |
|---|---|---|---|---|
| REGISTER ADJUSTMENT PATTERN | 3 | 50 | NG | NG |
| MISFIRING MONITOR PATTERN | 1 | 500 | OK | OK |
| PRELIMINARY EJECTION PATTERN | 2 | 200 | OK | NG |

FIG.9

METHOD AND APPARATUS FOR PRINTING

BACKGROUND OF THE INVENTION

1. Field of the Invention

The present invention relates to a method and an apparatus for printing, capable of performing maintenance operations, while printing a plurality of images on a continuous sheet, at intermediate areas located between one of the images and next one of the images.

2. Description of the Related Art

In an inkjet printing apparatus, in the case where printing is performed using a rolled continuous sheet used for mass printing such as laboratory printing, maintenance operations for maintaining the performance of equipment used in the printing apparatus are sometimes performed while the continuous sheet is being conveyed. As to a maintenance operation requiring printing on a surface of the continuous sheet in such maintenance operations, a required maintenance pattern is printed on a non-image part that is an intermediate area located between areas where images being products are to be printed and that is an area where image printing is not intended.

Each of the maintenance patterns has the purpose of maintaining the performance of equipment and there exists a plurality of patterns such as, for example, a preliminary ejection pattern, a misfiring monitor pattern, a register adjustment pattern, a position adjustment pattern. The preliminary ejection pattern is printed for the purpose of stabilizing ink ejection by preventing a nozzle from being clogged during printing and periodically performing preliminary ejection at intervals causing no defective ink ejection, in the inkjet printing apparatus. The misfiring monitor pattern is printed for the purpose of periodically monitoring whether defective ink ejection occurs due to misfiring of ink from a nozzle during printing. The register adjustment pattern is printed for the purpose of periodically correcting a timing lag (hereinafter, also referred to as misregistration) of ink ejection onto the sheet surface which would occur from moment to moment during printing. Each maintenance pattern is controlled to be printed on a non-image part located between one image and next image in accordance with a mutually different purpose and with different frequency for each maintenance operation.

In Japanese Patent Laid-Open No. 2011-240492, control is performed so as to print, in a predetermined order, a plurality of maintenance patterns including the preliminary ejection pattern and the misfiring monitor pattern and unit images. In addition, even in the case where a joint of the rolled continuous sheet has been detected, control is performed so as to change the order of printing the respective maintenance patterns such that the respective maintenance patterns are printed at fixed intervals.

In the maintenance patterns, there exist ones required to be analyzed by a reader. In the case of the above-mentioned misfiring monitor pattern, the pattern formed on the sheet surface is read by the reader and analysis is performed so as to clarify the presence or absence of misfiring nozzle by nozzle. The pattern to be read is required to have a high resolution corresponding to an arrangement resolution of nozzle arrays a print head includes, and analysis is performed, for each print, on all the nozzles used for printing. Therefore, in the case of the misfiring monitor pattern, the amount of computation of data processing is large. Furthermore, the resister adjustment pattern is also one of the maintenance patterns analysis of which is necessary, and after the pattern has been formed, the pattern is read by the reader and analysis is performed in the same manner as the misfiring monitor pattern. The pattern to be read is required to have a resolution which is high enough to allow recognition of dot displacement of ink droplets. In addition, since there exist many factors which would constitute a contributing factor for misregistration, the amount of computation which is required to derive a plurality of amounts of misregistration to be corrected for the contributing factor is also large. Therefore, in the case of the register adjustment pattern, the amount of computation of data processing becomes further larger than that of the misfiring monitor pattern. In this manner, the amount of data processing is enormous both for the misfiring monitor pattern and the register adjustment pattern. Although the time required for analysis greatly depends on the performance of a CPU, even a high-grade CPU cannot reduce, to zero, the processing time of a large amount of data, which is required at the time of analyzing the maintenance pattern. Accordingly, a certain period of time is required for analysis although the analysis depends on the processing capability of the CPU mounted on the reader.

Here, control of printing a plurality of maintenance patterns simply in predetermined order will be considered.

In controlling to print the plurality of maintenance patterns in the predetermined order, it is assumed that the misfiring monitor pattern and the register adjustment pattern may be sometimes printed at neighboring positions on the sheet surface. In this case, the register adjustment pattern is read after the misfiring monitor pattern has been read and while it is being analyzed. That is, analysis of the misfiring monitor pattern is temporarily suspended, the register adjustment pattern is read, and thereafter analysis of the misfiring monitor pattern is restarted. As to the misfiring monitor pattern, analysis processing is temporarily suspended because of interruption of reading of the register adjustment pattern. As to the register adjustment pattern, after the pattern has been read, analysis is to be started, waiting until analysis of the misfiring monitor pattern is terminated. Therefore, it takes more time for printing the misfiring monitor pattern and the register adjustment pattern than it originally takes for analyzing each of the misfiring monitor pattern and the register adjustment pattern. At the time of falling into such a case, a timing at which a printing apparatus recognizes discovery of misfiring of a nozzle is delayed in the case of the misfiring monitor pattern and thus misfiring of the nozzle is left as it is, which leads to useless printing of images that are unworthy for the products. In addition, in the case of the register adjustment pattern, since the actual amount of misregistration varies with time, a difference between a past misregistration amount derived from analysis and a current misregistration amount is increased. Therefore, in the case where correction is performed on the basis of that analysis, degradation of image quality may possibly be induced let alone improvement of image quality. As mentioned above, in the case where the maintenance patterns, analysis of which is required, interfere with each other, there arise problems in which maintenance operations cannot be performed in real time, thereby leading to the increase in amount of useless printed materials and the degradation of image quality of the printed materials as a result.

In addition, a non-image part (also referred to as a non-image area or a blank area as the case may be) which includes the maintenance pattern is an area to be separated from the image being the product and to be finally discarded as a waste. In contrast to this, the discardable waste size of the non-image part is determined in advance for reasons of configuration of the printing apparatus. In controlling of printing the plurality of maintenance patterns in predetermined order, a case where many maintenance patterns are printed on one non-image part is also assumed. At this time, in the case where the size of the non-image part is not within the discardable size for reasons of configuration of the printing apparatus, there will be increased the possibility that paper jam occurs in the printing apparatus due to contact of the continuous sheet on a conveyance path with a paper waste that is left not-discarded. In the case where paper jam actually occurs, a large amount of time is taken for recovery of the printing apparatus including post-processing of the paper jam. In addition, a product, printing of which has been in progress, is wasted, thereby leading to a large disadvantage including the fact that ink and the continuous sheet are uselessly consumed.

In the method for printing maintenance patterns in Japanese Patent Laid-Open No. 2011-240492, in changing the printing order, the influence caused by mutual interference of the maintenance patterns is not taken into account. Therefore, Japanese Patent Laid-Open No. 2011-240492 cannot solve the above-mentioned various subject matters.

SUMMARY OF THE INVENTION

The present invention has been made on the basis of recognition of the above-mentioned subject matters and an object of the present invention is to provide a method and an apparatus for printing capable of performing plural kinds of maintenance operations, with no mutual interference, while performing printing on a continuous sheet.

In order to attain the above-mentioned object, a method for printing on a continuous sheet with an inkjet head according to the present invention includes printing a plurality of images in sequence and performing plural kinds of maintenance operations by using intermediate areas located between one of the images and next one of the images, in accordance with a schedule, and setting the schedule such that a first maintenance operation included in the plural kinds of maintenance operations and a second maintenance operation which is performed with different frequency from that of the first maintenance operation are not performed at the same intermediate area.

According to the present invention, it becomes possible to appropriately perform a plurality of maintenance operations required for maintenance while performing printing on the continuous sheet, in accordance with the configuration and processing capability of the apparatus. Therefore, high throughput and high quality printing becomes possible.

Further features of the present invention will become apparent from the following description of exemplary embodiments (with reference to the attached drawings).

BRIEF DESCRIPTION OF THE DRAWINGS

FIG. 6 is a diagram showing the relationship between FIGS. 6A and 6B;

FIGS. 6A and 6B are flowcharts illustrating details of printing determination processing according to the embodiment of the present invention;

FIG. 9 is a table explaining one example of updating of the printing determination result illustrated in FIG. 8.

DESCRIPTION OF THE EMBODIMENTS

Hereinafter, a preferred embodiment of the present invention will be exemplarily described in detail with reference to the accompanying drawings. However, relative arrangement, device shapes and the like of constituent elements described in this embodiment are merely illustrative and there is no intention to limit the scope of the present invention only thereto.

In the present specification, it is to be noted that a "printing apparatus" includes a multi-functional machine in which a printing function is compounded with other functions, and manufacturing equipment for forming images and patterns on a print sheet and the like, without being limited to special-purpose machinery which is specialized for the printing function. The present invention is widely applicable to various printing apparatuses such as printers, multi-functional printers, copying machines, facsimile machines, manufacturing equipment for various devices and the like.

The printing apparatus of the present example is a high-speed line printer that uses a long and continuous sheet and that copes with both of single-sided printing and double-sided printing. The printing apparatus of the present example is suitable to, for example, the field of performing printing on a large number of sheets in printing laboratories and the like. In the present specification the long and continuous sheet refers to a continuous sheet which is longer than a length of a repetitive printing unit in a conveying direction. In addition, in the present specification, the repetitive printing unit refers to, for example, one page or a unit image. In the present specification, even in the case where plural small images, characters and blanks are mixed in an area of one printing unit (one page), things included in the area concerned, collectively, refer to one unit image. That is, the unit image means one printing unit (one page) in the case where a plurality of pages is printed in sequence on the continuous sheet. Note that, in some cases it is simply referred to as an image, not referred to as the unit image. The length of the unit image is different depending on the size of an image to be printed. For example, an L-size photograph becomes 135 mm in length in a sheet conveying direction and an A4-size one becomes 297 mm in the sheet conveying direction.

Figure 1:
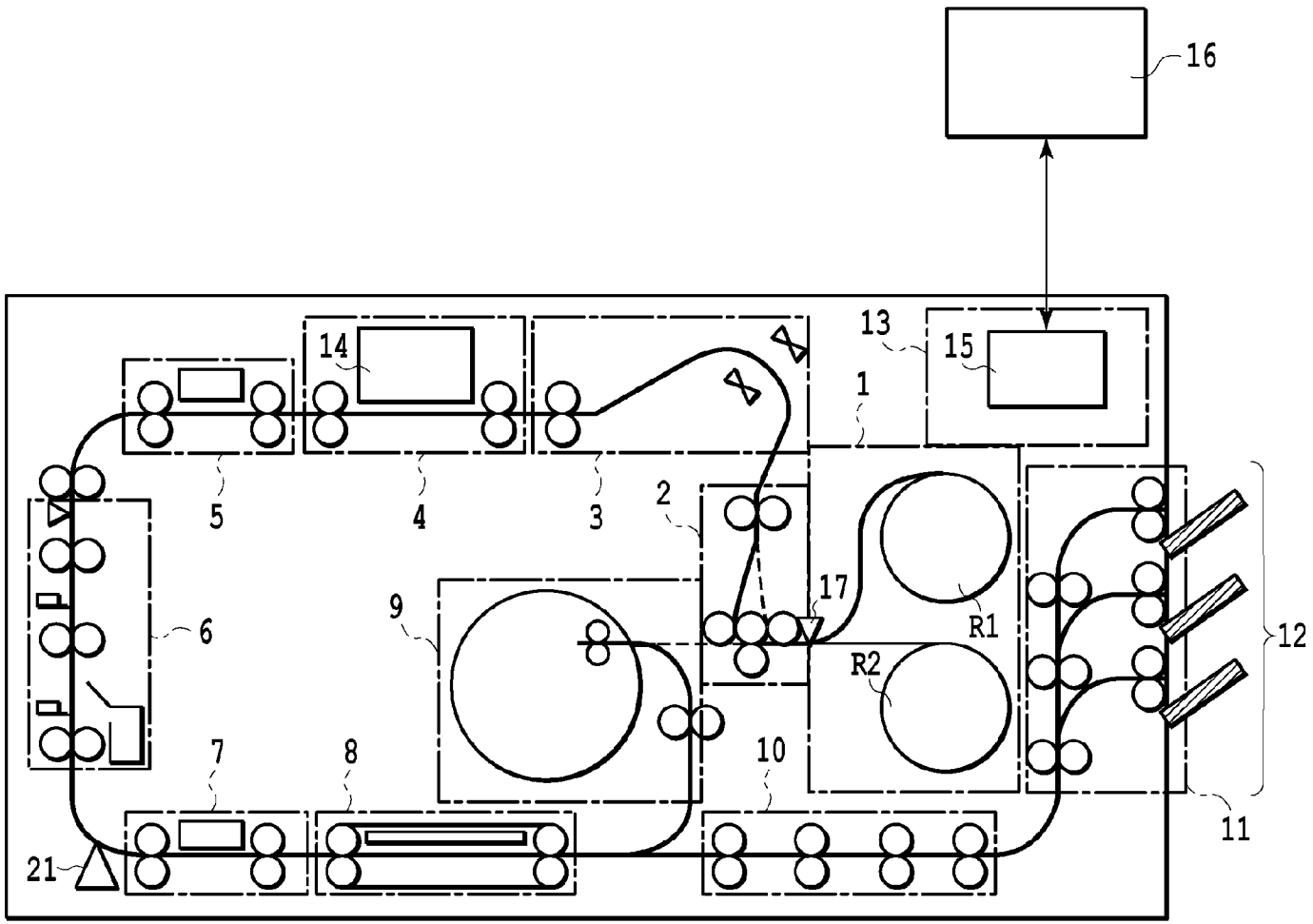
FIG. 1 is a schematic sectional diagram illustrating a general configuration of a printing apparatus according to an embodiment of the present invention.

FIG. 1 is a schematic sectional diagram illustrating an inner configuration of the printing apparatus. The printing apparatus according to the present embodiment is capable of performing printing on both surfaces, that is, a first surface of the sheet and a second surface on the rear side of the first surface, through the use of the rolled sheet. The printing apparatus generally includes, within it, respective units of a sheet supply unit 1, a decurl unit 2, a skew correction unit 3, a print unit 4, an inspection unit 5, a cutter unit 6, an information recording unit 7, a drying unit 8, a reversing unit 9, a discharge conveyance unit 10, a sorter unit 11, a discharge unit 12 and a control unit 13. The discharge unit 12 refers to a unit that performs discharging processing, including the sorter unit 11. The sheet is conveyed by a conveying mechanism including a roller pair and belts, along a sheet conveyance path shown by a solid line in the drawing, and is processed by the respective units. Note that, at arbitrary positions on the sheet conveyance path, the side close to the sheet supply unit 1 is referred to as the "upstream" and its opposite side is referred to as the "downstream".

The sheet supply unit 1 is a unit for holding and supplying the rolled continuous sheet. The sheet supply unit 1 is capable of housing two rolls of sheet R1 and R2 and is configured to alternatively draw out and supply the sheet. Note that the number of rolls capable of being housed is not limited to two and it may house one roll or three or more rolls. In addition, as long as the sheet is a continuous one, it is not limited to the rolled one. For example, it may be a continuous sheet, having perforations formed per unit length, which is folded back for every perforation, is stacked and is housed in the sheet supply unit 1.

The decurl unit 2 is a unit that loosens a curl (warpage) of the sheet supplied from the sheet supply unit 1. In the decurl unit 2, decurling force is exerted to loosen the curl by passing the sheet in a curved state so as to be subjected to warpage in the opposite direction of the curl by using two pinch rollers for one drive roller.

The skew correction unit 3 is a unit that corrects a skew of the sheet which has passed through the decurl unit 2. In the present specification, the skew of the sheet means an inclination relative to an original direction of forward movement of the sheet or a state where the sheet is conveyed with an inclination relative to the original direction of forward movement. The skew of the sheet is corrected by pressing an end of the sheet located on the side serving as a reference, against a guide member. In the skew correction unit 3, a loop is formed on the conveyed sheet.

The print unit 4 is a sheet processing unit that forms an image by performing printing on the sheet by a print head 14 from above relative to the conveyed sheet. That is, the print unit 4 is a processing unit that performs predetermined processing on the sheet. The print unit 4 includes a plurality of conveyor rollers for conveying the sheet. As the print head 14, there is used a line type print head in which inkjet nozzle arrays are formed within a range covering a maximum width of a sheet, use of which is assumed. The print head 14 may include a plurality of print heads and the plurality of print heads is arranged in parallel with one another along the conveying direction. In the present example, the print head 14 includes seven print heads corresponding to seven colors of C (cyan), M (magenta), Y (yellow), LC (light cyan), LM (light magenta), G (gray) and K (black). Note that the number of colors and the number of print heads are not limited to seven. The line head for each color may be formed with a single seamless nozzle chip or may be formed with divided nozzle chips which are regularly arrayed in a line or in staggered arrangement. As the inkjet system, there can be adopted a system using a heater element, a system using a piezoelectric element, a system using an electrostatic element, a system using an MEMS element or the like. Ink of each color is supplied from each ink tank to the print head 14 via each ink tube.

The inspection unit 5 is a unit for optically reading an inspection pattern and an image printed on the sheet by the printer unit 4 by a scanner and for inspecting a state of each nozzle in the print head 14, a sheet conveying state, an image position and the like to thereby determine whether the image has been correctly printed. The scanner has a CCD image sensor and a CMOS image sensor. In the present embodiment, it is possible to appropriately select a method of confirming a state of the apparatus from among various confirming methods. For example, the method may be of the type in which an ejected state of ink is confirmed by reading a pattern for confirming a state of the print head or may be of the type in which success or failure of printing is confirmed by comparison between a printed image and an original image.

Figure 2:
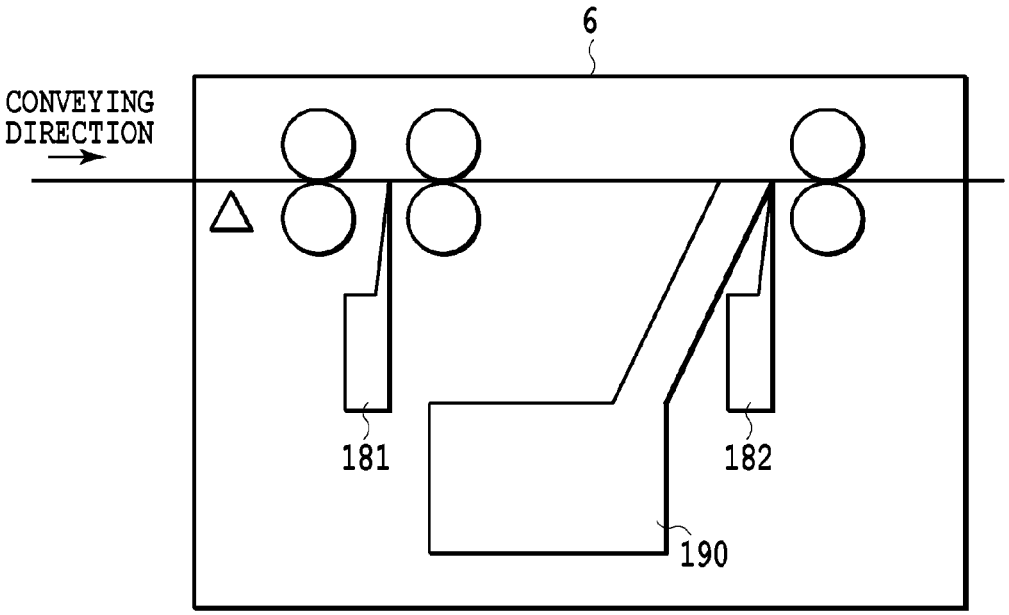
FIG. 2 is a detailed illustration of a cutter unit 6 according to the embodiment of the present invention.

The cutter unit 6 is a unit which includes a mechanical cutter for cutting, into a predetermined length, the sheet after printing. Details of the cutter unit 6 will be described using FIG. 2. Referring to FIG. 2, the cutter unit 6 includes a first cutter 181, a second cutter 182 and a cutter trash can 190, and these are arranged within the cutter unit 6. The sheet conveyed from the inspection unit 5 is cut by the first cutter 181 for every set of an image of a length of a predetermined printing unit and a non-image part which includes the plural kinds of maintenance patterns while being conveyed in the conveying direction. The length of the predetermined printing unit is different depending on the size of an image to be printed. For example, the length of an L-size photograph in the conveying direction is 135 mm and the length of an A4-size in the conveying direction is 297 mm. The length of the non-image part is different depending on the number and kind of the maintenance patters to be printed. The sheet which has been cut into the set of the image and the non-image part by the cutter 181 is conveyed, only the non-image part is cut off as a cut waste by the second cutter 182, and the image is separated from the non-image part. The cut waste that has been cut off falls down into the cutter trash can 190 and is discarded. The sheet which has been separated into only the image by the second cutter 182 is conveyed to the information recording unit 7 illustrated in FIG. 1. In FIG. 2, although the sheet is horizontally conveyed from the left side toward the right side, the conveying direction of the cutter unit is not limited to the above and the sheet may be vertically conveyed as illustrated in FIG. 1. The cutter trash can 190 is provided immediately before an edge of blade of the second cutter 182 so as to receive the cut-off cut waste.

The information recording unit 7 is a unit that records print information (inherent information, for example, an order management number and the like) such as a serial number, a date and the like, printed on a non-printed area (for example, a rear surface) of the cut sheet. Recording is performed by printing characters and codes by an inkjet printing system, a heat transfer printing system or the like. A sensor 21 that detects a leading end edge of the cut sheet is provided on the upstream side of the information recording unit 7 and on the downstream side of the cutter unit 6. A timing at which information is recorded by the information recording unit 7 is controlled on the basis of a detection timing of the sensor 21.

The drying unit 8 is a unit for heating the sheet printed by the print unit 4 to thereby dry ink applied thereto in a short period of time. Within the drying unit 8, hot air is applied to the passing sheet at least from its lower surface side to thereby dry an ink-applied surface. Note that, a drying system is not limited to a system of applying hot air and a system of irradiating the sheet front surface with electromagnetic waves (such as ultraviolet rays, or infrared rays) may be adopted.

The above-mentioned sheet conveyance path leading from the sheet supply unit 1 to the drying unit 8 is referred to as a first path. The first path has a shape of making a U-turn while leading from the print unit 4 to the drying unit 8, and the cutter unit 6 is located in the middle of the U-turn shape.

The reversing unit 9 is a unit for temporarily taking up the continuous sheet, printing on the front surface of which has been completed, to thereby turn it upside down, in performing double-sided printing. The reversing unit 9 is provided in the middle of a path (loop path) (referred to as a second path) that is for supplying the sheet having passed through the drying unit 8 again to the print unit 4, and that leads from the drying unit 8 to the print unit 4 via the decurl unit 2. The reversing unit 9 includes a rotating take-up rotor (drum) for taking up the sheet. The continuous sheet which is not yet cut after printing on its front surface has been completed is temporarily rolled up by the take-up rotor. At the completion of taking-up, the take-up rotor reversely rotates, and thus the rolled up sheet is sent out in the reverse order of taking-up, is supplied to the decurl unit 2 and is sent to the print unit 4. Since the sheet is turned upside down, the print unit 4 is allowed to perform printing on its rear surface. In the case where the sheet supply unit 1 is a first sheet supply unit, the reversing unit 9 can be regarded as a second sheet supply unit. More concrete operations of double-sided printing will be described later.

The discharge conveyance unit 10 is a unit for conveying the sheet cut by the cutter unit 6 and dried by the drying unit 8, to thereby deliver the sheet to the sorter unit 11. The discharge conveyance unit 10 is provided in a path (referred to as a third path) which is different from the second path where the reversing unit 9 is provided. In order to selectively guide the sheet conveyed in the first path to one of the second path and the third path, a path switch mechanism including a movable flapper is provided at a branching position (called a "discharge branching position") in the path.

The discharge unit 12 which includes the sorter unit 11 is provided on a side part of the sheet supply unit 1 and at the end of the third path. The sorter unit 11 is a unit for sorting out the printed sheets for each group, as required. The sorted sheets are discharged to a plurality of trays the discharge unit 12 has. In this manner, the third path has a layout in which the sheet is discharged to the side opposite to the print unit 4 and the drying unit 8 with the sheet supply unit 1 sandwiched, by passing under the sheet supply unit 1.

As described above, the sheet supply unit 1 to the drying unit 8 is provided in order in the first path. The first path is branched to the second path and the third path after the drying unit 8, the reversing unit 9 is provided in the middle of the second path, and the second path joins with the first path after the reversing unit 9. The discharge unit 12 is provided at the end of the third path.

The control unit 13 is a unit controlling the respective units of the whole printing apparatus. The control unit 13 has a CPU, a storage device, a controller provided with various control units, an external interface, and an operation unit 15 through which a user performs input and output operations. The operation of the printing apparatus is controlled on the basis of a command from the controller or a host device 16 such as a host computer or the like which is connected to the controller via the external interface.

Figure 3:
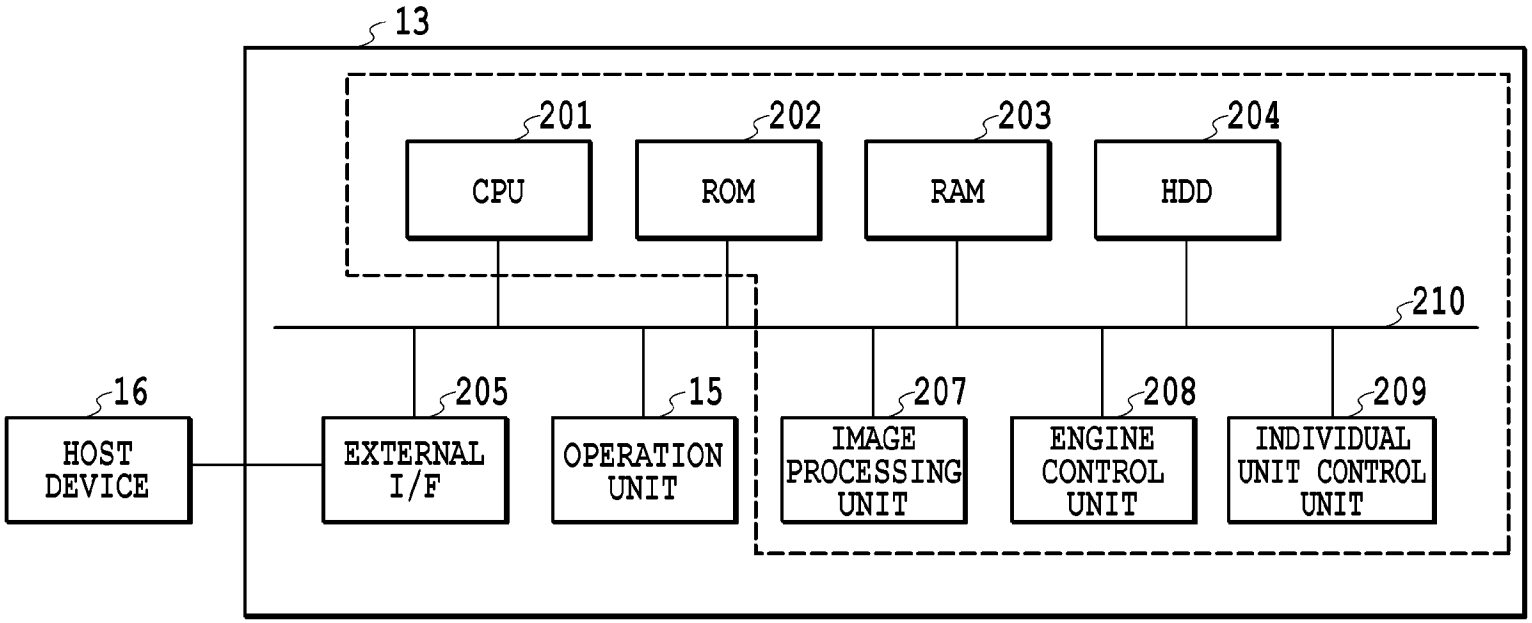
FIG. 3 is a block diagram explaining a control configuration of the printing apparatus according to the embodiment of the present invention.

FIG. 3 is a block diagram illustrating a concept of the control unit 13. The controller (a range surrounded with a broke line) included in the control unit 13 is configured by including a CPU 201, a ROM 202, a RAM 203, an HDD) 204, an image processing unit 207, an engine control unit 208 and an individual unit control unit 209. The CPU 201 (Central Processing Unit) controls operations of the respective units of the printing apparatus, in an integrated manner. The ROM 202 stores a program the CPU 201 executes, and fixed data required for various operations of the printing apparatus. The RAM 203 is used as a work area of the CPU 201, is used as an area for temporarily storing various pieces of received data, and stores various pieces of set data. The HDD 204 (hard disc) is capable of storing and reading the program the CPU 201 executes, print data, setting information required for various operations of the printing apparatus. The operation unit 15 serves as an input/output interface with the user and includes input units such as a hard key and a touch panel and output units such as a display on which information is displayed and a voice generator.

A unit for which high speed data processing is required is provided with a dedicated processing unit. The image processing unit 207 performs image processing on the print data the printing apparatus handles. The image processing unit 207 converts a color space (for example, YCbCr) of input image data into a standard RGB color space (for example, sRGB). In addition, various image processing operations such as resolution conversion, image analysis, image correction and the like are performed on the image data. The print data obtained by these image processing operations is stored in the RAM 203 or the HDD 204. The engine control unit 208 controls drive of the print head 14 of the print unit 4 on the basis of a control command received from the CPU 201 or the like and in accordance with the print data. The engine control unit 208 also controls a conveyor mechanism of each unit within the printing apparatus. The individual unit control unit 209 is a sub controller for individually controlling the respective units of the sheet supply unit 1, the decurl unit 2, the skew correction unit 3, the inspection unit 5, the cutter unit 6, the information recording unit 7, the drying unit 8, the reversing unit 9, the discharge conveyance unit 10, the sorter unit 11 and the discharge unit 12. Operations of the individual units are controlled by the individual unit control unit 209 on the basis of a command from the CPU 201. The external interface 205 is an interface (I/F) for connecting the controller to the host device 16 and is a local I/F or a network I/F. The above-mentioned constituent elements are connected with one another through a system bus 210.

The host device 16 is a device serving as a supply source of image data for causing the printing apparatus to perform printing. The host device 16 may be a general-purpose or dedicated computer or may be dedicated image equipment such as an image capture having image reader unit, a digital camera, a photo storage. In the case where the host device 16 is a computer, an OS, application software generating the image data and a printer driver for the printing apparatus are installed in a storage included in the computer. Note that it is not essential to realize all the above-mentioned processing operations by software, and a part or all of the processing operations may be realized by hardware.

Next, the basic operation at the time of printing will be described. Since the operation for printing is different between a single-sided printing mode and a double-sided printing mode, the respective operations will be described.

In the single-sided printing mode, there is printed, in the print unit 4, a front surface (a first surface) of the sheet which has been supplied from the sheet supply unit 1 and processed respectively by the decurl unit 2 and the skew correction unit 3. A plurality of images is formed side by side on the long and continuous sheet, by printing in sequence images of a predetermined unit length (unit images) in the conveying direction. The printed sheet is cut for every unit image by the cutter unit 6, after passing through the inspection unit 5. As to the cut sheets that have been cut off, print information is recorded on a rear surface of each sheet by the information recording unit 7 as required. Then, the cut sheets are conveyed sheet by sheet to the drying unit 8 and are dried. The cut sheets dried are then sequentially discharged and stacked in the trays of the discharge unit 12 via the discharge conveyance unit 10. In contrast, the sheet which has been left on the side of the print unit 4 by final cutting of the unit image is sent back to the sheet supply unit 1 and is taken up by the roll R1 or the roll R2. In single-sided printing, the sheet is processed passing through the first path and the third path and does not pass through the second path as described above.

In contrast, in the double-sided printing mode, a rear surface (a second surface) print sequence is executed following a front surface (the first surface) print sequence. In the first front surface print sequence, operations of the respective units ranging from the sheet supply unit 1 to the inspection unit 5 are the same as the operations in the above-mentioned single-sided printing. A cutting operation is not performed by the cutter unit 6 and the continuous sheet is conveyed to the drying unit 8 in unchanged form. After ink on the front surface has been dried by the drying unit 8, the sheet is guided not to the path (the third path) on the side of the discharge conveyance unit 10, but to the path (the second path) on the side of the reversing unit 9. In the second path, the sheet is taken up by the take-up rotor of the reversing unit 9 which rotates in a forward direction (in a counterclockwise direction in the drawing). In the case where all the printing operations scheduled to be performed on the front surface have been completed in the print unit 4, a rear end of a printed area of the continuous sheet is cut by the cutter unit 6. The continuous sheet on the downstream side in the conveying direction with reference to a cut position (the printed side of the sheet) is fully taken up down to the sheet rear end (the cut position) by the reversing unit 9 through the drying unit 8. In contrast, at the same time as taking-up in the reversing unit 9, the continuous sheet which has been left on the upstream side (on the side of the print unit 4) in the conveying direction with reference to the cut position is sent back to the sheet supply unit 1 such that the sheet leading end (the cut position) is not left in the decurl unit 2 and the sheet is taken up to the roll R1 or the roll R2. Collision with the sheet supplied again in the following rear surface print sequence is avoided by this sending-back (back-feeding).

The above-mentioned front surface print sequence is switched to the rear surface print sequence. The take-up rotor of the reversing unit 9 rotates in a direction (in a clockwise direction in the drawing) opposite to that at the time of taking-up. The end of the taken-up sheet (the trailing end of the sheet at the time of taking-up serves as the leading end of the sheet at the time of being sent out) is sent into the decurl unit 2 along a broken line path in the drawing. The curl given by the take-up rotor is corrected by the decurl unit 2. That is, the decurl unit 2 is provided between the sheet supply unit 1 and the print unit 4 in the first path and between the reversing unit 9 and the print unit 4 in the second path, to serve as a common unit which acts to decurl it in both of the paths. The sheet which has been turned upside down is sent to the print unit 4 through the skew correction unit 3 and printing is performed on the rear surface of the sheet. The printed sheet is sent via the inspection unit 5 and is cut for every predetermined unit length which is set in advance by the cutter unit 6. Since printing has been performed on the both surfaces of each cut sheet, recording by the information recording unit 7 is not performed. The cut sheets are conveyed to the drying unit 8 one by one, are sequentially discharged to the discharge unit 12 of the sorter unit 11 through the discharge conveyance unit 10, and are stacked. In this manner, in double-sided printing, the sheet is processed while passing in order of the first path, the second path, the first path and the third path.

Next, scheduling of maintenance operations which is a characteristic of the present embodiment will be described in detail. A basic concept is that, in performing, during execution of printing, the first maintenance operation and the second maintenance operation which are different from each other in execution frequency or cycle, a schedule for printing and maintenance is set such that a first maintenance operation and a second maintenance operation are not performed at the same non-image part.

Figure 4:
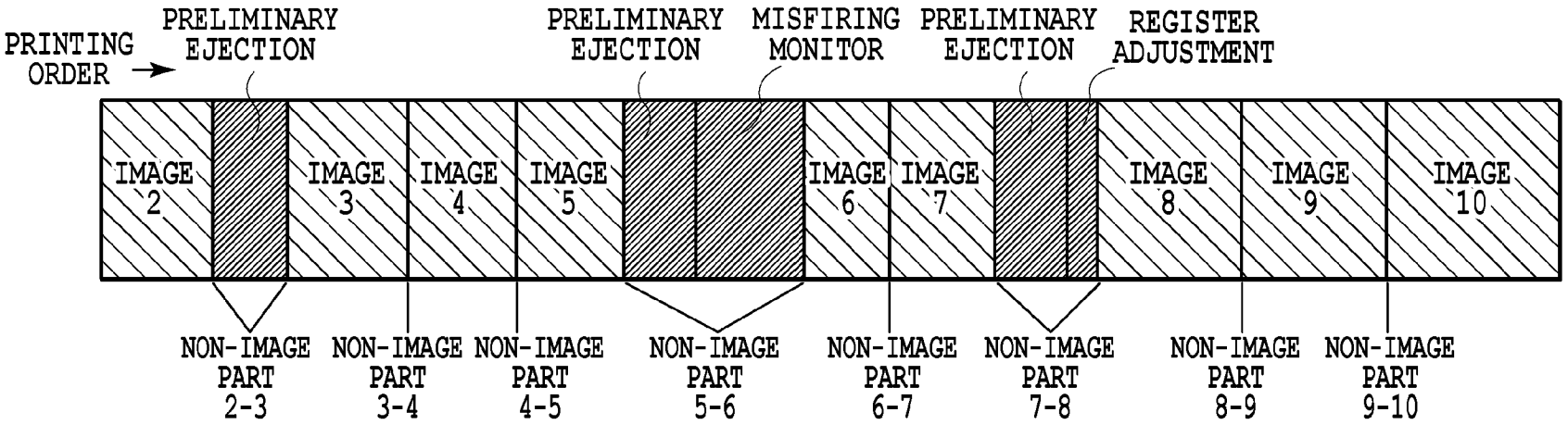
FIG. 4 is a diagram illustrating printing order of patterns to be printed by the printing apparatus according to the embodiment of the present invention.

FIG. 4 is a diagram illustrating printing order of patterns to be printed on the surface of the continuous sheet by the printing apparatus. In FIG. 4, printing is performed from the left side toward the right side and images from an image 2 to an image 10 are indicated. There is numbered a non-image part that is an intermediate area located between one of the images and next one of the images and that is an area where printing of an image being a product is not intended, in accordance with the numbers of the both-side images that sandwich the non-image part. For example, an intermediate area between the image 2 and the image 3 is a non-image part 2-3. Similarly, an intermediate area between the image 5 and the image 6 is a non-image part 5-6, and an intermediate area between the image 8 and the image 9 is a non-image part 8-9. A printing determination is made as to whether or not there are to be printed the plural kinds of maintenance patterns such as a preliminary ejection pattern, a misfiring monitor pattern, a register adjustment pattern, and the presence or absence of printing of each maintenance pattern is determined, in the respective non-image parts between the images illustrated.

Figure 5:
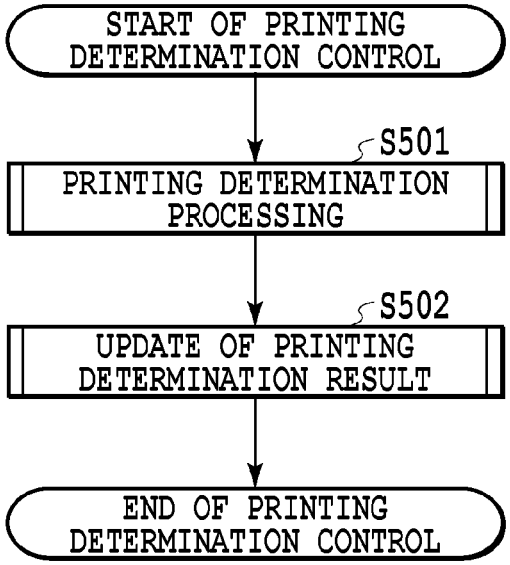
FIG. 5 is a flowchart of printing determination control for determining the presence or absence of printing of plural kinds of maintenance patterns in each non-image part, according to the embodiment of the present invention.

There is illustrated, in a flowchart in FIG. 5, a flow of printing determination control determining the presence or absence of printing of the plural kinds of maintenance patterns on the respective non-image parts in FIG. 4. With reference to FIG. 5, in printing determination control, first, in printing determination processing in step S501, a result of the presence or absence of printing of all kinds of maintenance patterns, that is, a maintenance pattern to be printed is determined once (a first determination). Then, in updating a printing determination result in step S502, the result of the presence or absence of printing for each maintenance pattern is updated (a second determination) as required, depending on the priority order of the respective maintenance patterns. Details of the printing determination processing in step S501 in FIG. 5 will be described using FIGS. 6A and 6B and FIG. 7A to FIG. 7D. In addition, details of updating of the printing determination result in step S502 will be described using FIG. 8 and FIG. 9.

Figure 6B:
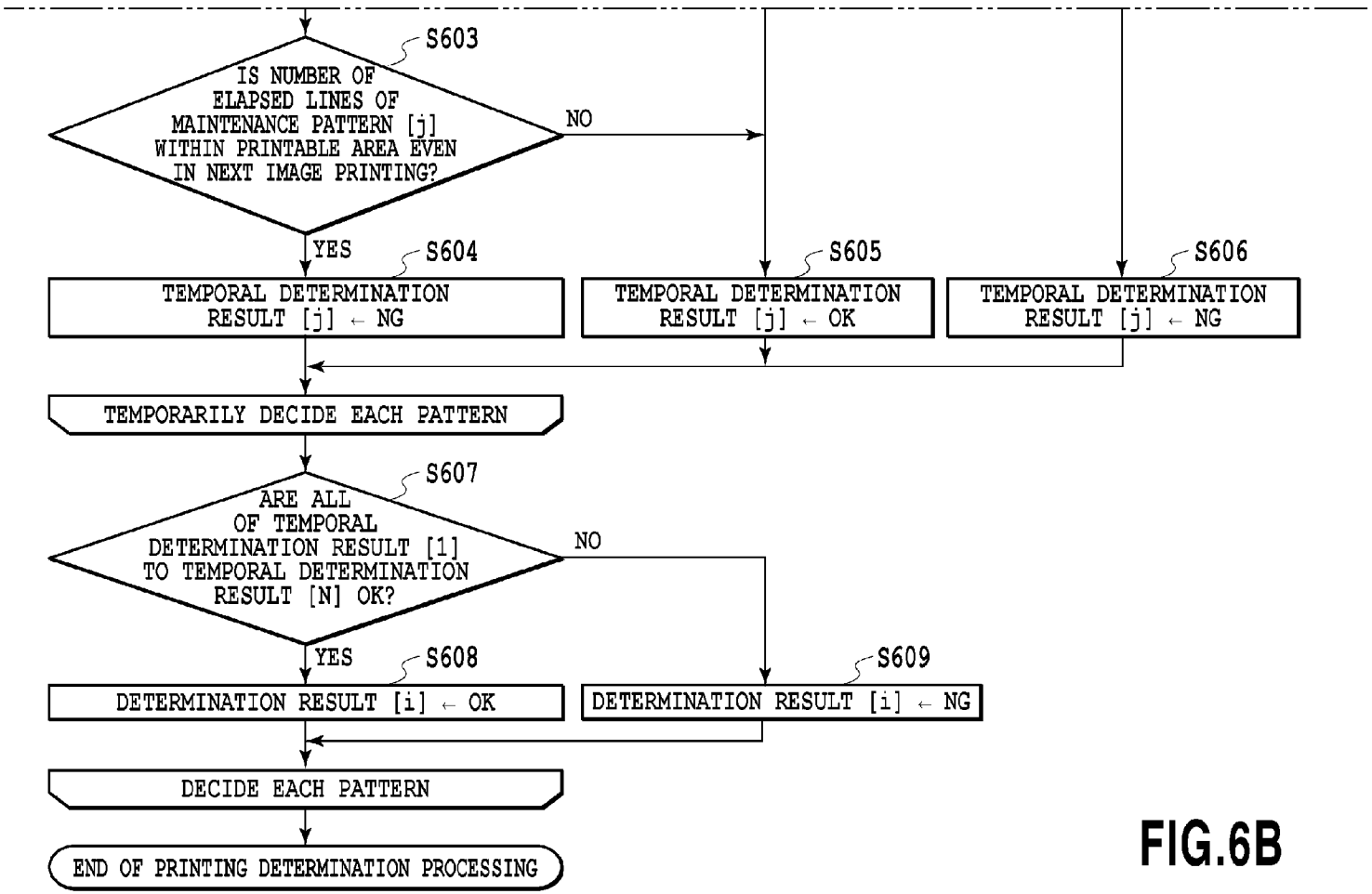

FIGS. 6A and 6B are flowcharts illustrating details of the printing determination processing in step S501 in FIG. 5. In FIGS. 6A and 6B, a sign N denotes a number of elements, that is, a number of kinds of maintenance patterns. Signs [1], [i], [j] and [N], respectively, denote data on first, i-th, j-th and N-th elements in the number of elements N. A mark * inclusively indicates numerical values 1 to N including these 1, i, j and N. A maintenance pattern [*] denotes the name of a maintenance pattern as a *-th element in the number of elements N. Both of a temporal determination result [*] and a determination result [*] each denote flags holding a printing determination result (OK/NG) with respect to the maintenance pattern as the *-th element in the number of elements N. In addition, a distance in the conveying direction is defined by a number of print lines (hereinafter, also simply referred to as a number of lines) and is used in the present specification and the drawings.

FIG. 7A to FIG. 7D are schematic diagrams each illustrating a manner of determining printing of two kinds of maintenance patterns of the register adjustment pattern and the misfiring monitor pattern between the image 7 and the image 8. For the convenience of description, the number of kinds N of maintenance patterns is set to N=2, a maintenance pattern [1] is set to the register adjustment pattern, and a maintenance pattern [2] is set to the misfiring monitor pattern. In the following, details of the printing determination processing in step S501 in FIG. 5 will be described with reference to FIG. 7A to FIG. 7D.

Figure 7A:
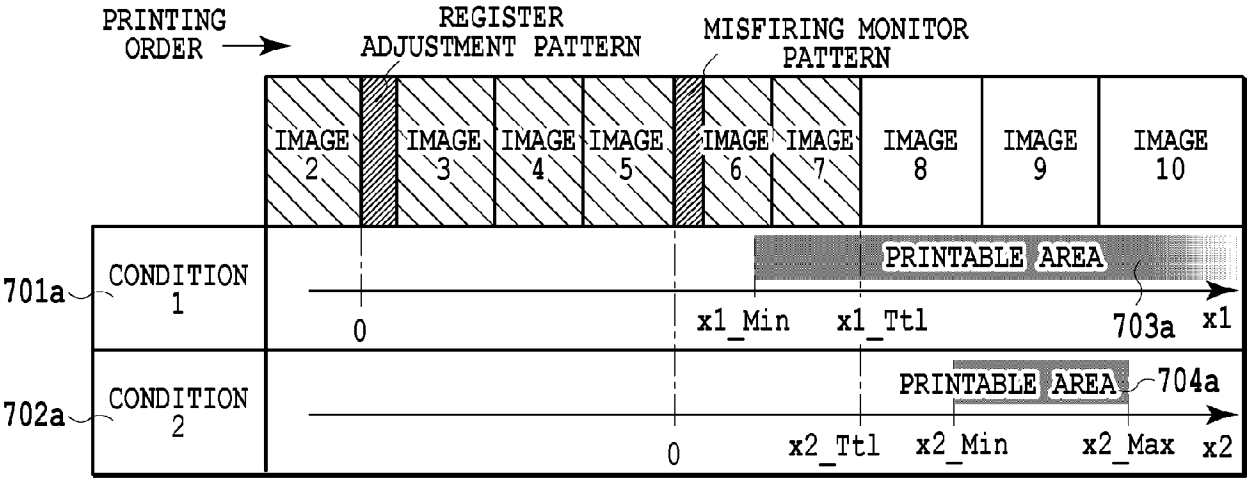
FIG. 7A to FIG. 7D are diagrams each illustrating a manner of determining printing of a maintenance pattern between an image 7 and an image 8 according to the embodiment of the present invention.

First, description of FIG. 7A will be made. FIG. 7A is a schematic diagram of a printing determination determining whether or not printing (the first maintenance operation) of the register adjustment pattern which is the maintenance pattern [1] is to be performed between the image 7 and the image 8. In the drawing, a condition 1 (701*a*) is a condition for printing the register adjustment pattern. A condition 2 (702*a*) is a condition for restricting printing of the misfiring monitor pattern which affects at the time of determining printing of the register adjustment pattern. Right-pointing arrows x1 and x2 are coordinate systems in a printing order direction in which previous print positions of the register adjustment pattern and the misfiring monitor pattern are, respectively, set to 0s. A position x1_Ttl and a position x2_Ttl in the respective coordinate systems each indicates the number of lines up to a position to which printing has been already determined to be performed on the surface of the continuous sheet, with reference to the previous print position of each of the register adjustment pattern and the misfiring monitor pattern. A band 703*a* and a band 704*a* respectively indicate printable areas on the surface of the continuous sheet in directions of the coordinate systems x1 and x2 of the condition 1 (701*a*) and the condition 2 (702*a*), that is, in the printing order direction. A gradationally displayed part indicates that there is no limit value, and the printable area range indicated by the band 703*a* indicates a position where the number of lines is not less than x1_Min and has no upper limit. In addition, the printable area range indicated by the band 704*a* is in a position where the number of lines is not less than x2_Min and not more than x2_Max.

A determination under the condition 1 (701*a*) corresponds to temporal determination loop processing of each pattern in the case where i=1 and j=1 hold in FIGS. 6A and 6B. Explaining in detail, first, in step S601 in FIGS. 6A and 6B, it is determined whether or not the position x1_Ttl is within the printable area indicated by the band 703*a*. Since the position x1_Ttl is within the area, the process proceeds to step S602 and it is checked whether the printable area indicated by the band 703*a* has an upper limit. Since the position has no upper limit, the process proceeds to step S605 and OK is set to the temporal determination result [1].

The condition 2 (702*a*) corresponds to temporal determination loop processing of each pattern in the case where i=1 and j=2 hold in FIGS. 6A and 6B. Explaining in detail, first, in step S601, it is determined whether the position x2_Ttl is within the printable area indicated by the band 704*a*. Since the position x2_Ttl is outside the area, the process proceeds to step S606 and NG is set to the temporal determination result [2].

In the processing performed so far, all temporal determination results of the register adjustment pattern are obtained. Then, in step S607, it is checked whether all the temporal determination results are OK. Here, since the temporal determination result [2] is NG, the process proceeds to step S609 and NG is set to the determination result [1]. Therefore, it is determined that printing of the register adjustment pattern is not performed.

Here, in determining printing of the register adjustment pattern which is the maintenance pattern [1], a determination result that allows printing is obtained as the printing condition for the register adjustment pattern itself in FIG. 7A. That is, since timing for a periodic register adjustment is entered based on an interval (a first interval) having a minimum number of lines x1_Min or more from the previous printing. The periodic register adjustment timing permits printing of the register adjustment pattern on the non-image part so as to perform register adjustment. However, as to the misfiring monitor pattern that is the maintenance pattern [2], since an interval (a second interval) having a minimum number of lines x2_Min or more from the previous printing has not been ensured and a time elapsed from the previous printing does not reach a predetermined amount, the misfiring monitor pattern is in a state of still being analyzed. In the case where the register adjustment pattern is printed in this state, a time required for analysis of both of the misfiring monitor pattern and the register adjustment pattern is increased, and thus correct maintenance (the maintenance operation) may not be performed. Therefore, the determination of not printing the register adjustment pattern is made. Because of this, it becomes possible to print the register adjustment pattern and the misfiring monitor pattern on non-image parts, at time and distance intervals at which they do not interfere with each other analytically.

Figure 7B:
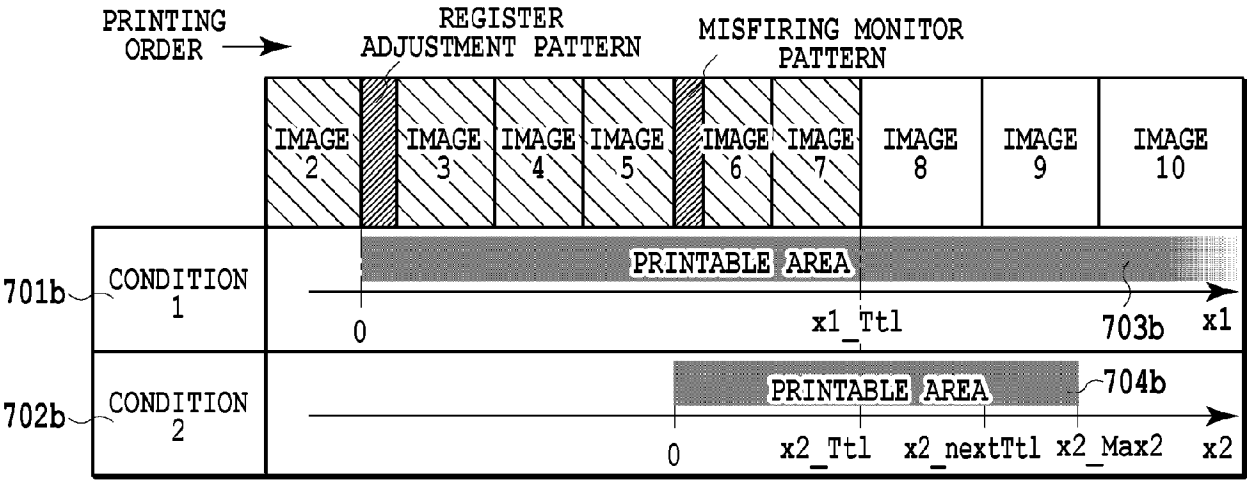

Next, description of FIG. 7B will be made. FIG. 7B is a schematic diagram of a determination determining whether or not there is to be performed printing (the second maintenance operation) of the misfiring monitor pattern which is the maintenance pattern [2] between the image 7 and the image 8. A condition 1 (701*b*) is a condition for restricting printing the register adjustment pattern which is the maintenance patter [1] which affects at the time of determining printing of the misfiring monitor pattern. A condition 2 (702*b*) is a printing condition for the misfiring monitor pattern. Definition of the right-pointing arrows x1 and x2 and the positions (the numbers of lines) x1_Ttl and x2_Ttl is the same as that in FIG. 7A. A position x2_nextTtl in the coordinate system x2 indicates a value of the number of lines x2_Ttl which is updated in the case where the image 8 which is the image to be printed next has been printed. That is, the value of the number of lines x2_nextTtl is a value obtained by adding the number of lines required for printing the image 8 to the number of lines x2_Ttl at the time of determining printing thereof. Bands 703*b* and 704*b* indicate printable areas on the surface of the continuous sheet, respectively, in directions of the coordinate systems x1 and x2 of the condition 1 (701*b*) and the condition 2 (702*b*), that is, in the printing order direction. Meaning of gradational display is the same as that in FIG. 7A, indicating that there is no limit value for the printable area range.

A determination under the condition (701*b*) corresponds to temporal determination loop processing of each pattern in the case where i=2 and j=1 hold in FIGS. 6A and 6B. Explaining in detail, first, in step S601 in FIGS. 6A and 6B, it is determined whether or not the position x1_Ttl is within the printable area indicated by the band 703*b*. Since the position x1_Ttl is within the area, the process proceeds to step S602 and it is checked whether or not the printable area indicated by the band 703*b* has an upper limit. Since there is no upper limit, the process proceeds to step S605 and OK is set to the temporal determination result [1].

The condition 2 (702*b*) corresponds to temporal determination loop processing of each pattern in the case where i=2 and j=2 hold in FIGS. 6A and 6B. Explaining in detail, first, in step S601 in FIGS. 6A and 6B, it is determined whether or not the position x2_Ttl is within the printable area indicated by the band 704*b*. Since the position x2_Ttl is within the area, the process proceeds to step S602 and it is checked whether or not the printable area indicated by the band 704*b* has an upper limit. Since the area has an upper limit, the process proceeds to step S603. In step S603, it is determined whether or not the position x2_Ttl is within the printable area indicated by the band 703*b* even after the image 8 which is the image to be printed next has been printed. For the determination, there is used a value of the number of lines x2_nextTtl which is updated in the case where the image 8 is printed. Since the position indicated by the number of lines x2_nextTtl is within the printable area, the process proceeds to step S604 and NG is set to the temporal determination result [2].

From the processing performed so far, all temporal determination results of the misfiring monitor pattern are obtained. Then, in step S607, it is checked whether or not all the temporal determination results are OK. Since NG is set to the temporal determination result [2], the process proceeds to step S609 and NG is set to the determination result [2]. Because of this, it is determined that printing of the misfiring monitor pattern is not performed.

Here, in determining printing of the misfiring monitor pattern which is the maintenance pattern [2], in FIG. 7B, there is made a determination that there is no problem regardless of the position of the register adjustment pattern on the surface of the continuous sheet. Both of the misfiring monitor pattern and the register adjustment pattern are patterns which are required to be analyzed and it is necessary to provide time and distance intervals so that they do not interfere with each other analytically in printing both patterns. In contrast to this, there has already been performed the processing of providing a distance between the register adjustment pattern and the misfiring monitor pattern, at the time of determining printing of the register adjustment pattern illustrated in FIG. 7A. Therefore, it becomes possible to appropriately maintain the time and distance intervals between the misfiring monitor pattern and the register adjustment pattern without regard to the position of the register adjustment pattern, at the time of determining printing of the misfiring monitor pattern.

As the printing condition for the misfiring monitor pattern itself, there is given a determination result of printing of the misfiring monitor pattern being possible between the image 7 and the image 8. However, it is also found that printing of the misfiring monitor pattern is in a state of being possible between the image 8 and the image 9, even after the image 8 which is the image to be printed next has been printed. Therefore, the determination of not printing the misfiring monitor pattern between the image 7 and the image 8 is made.

Figure 7C:
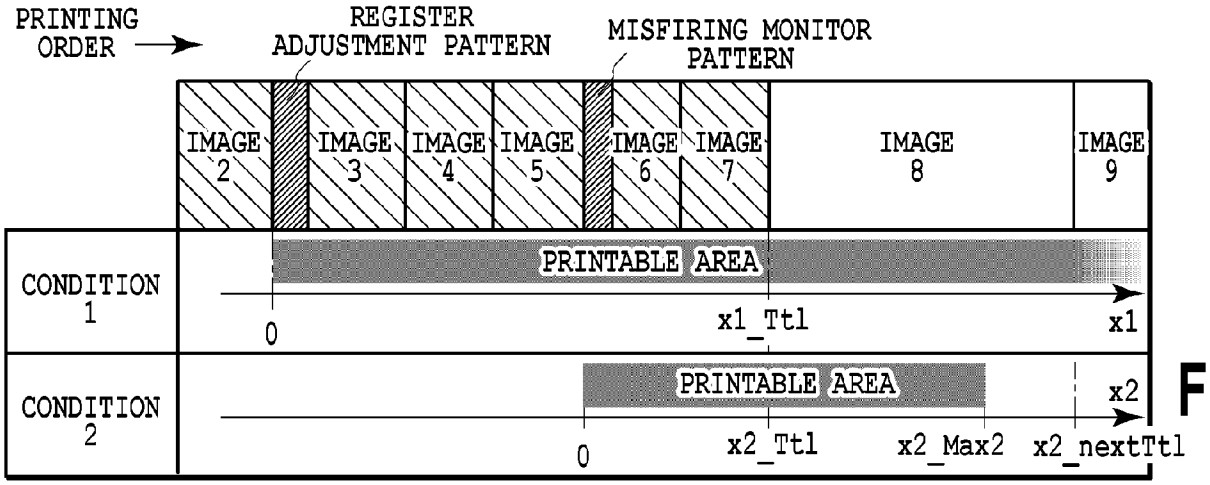

Next, description of FIG. 7C will be made. FIG. 7C is the same as FIG. 7B except that the number of print lines of the image 8 has been increased. That is, in FIG. 7B, the position of the number of lines x2_nextTtl in the coordinate system x2 is within the printable area indicated by the band 704*b*, whereas in FIG. 7C, the position is outside the printable area. If the image 8 which is the image to be printed next is printed, the number of lines up to a position where printing has been determined on the surface of the continuous sheet exceeds an upper limit value of the printable area as to the printing condition for the misfiring monitor pattern. Therefore, printing of the misfiring monitor pattern between the image 8 and the image 9 is not possible. In such a case, the determination of printing the misfiring monitor pattern between the image 7 and the image 8 is made.

Owing to the above, printing control for maintenance (the maintenance operation) can be realized by scheduling the cycle so as not to be less than regular intervals and the frequency so as not to be redundant, as to the misfiring monitor pattern.

In the case where a plurality of maintenance patterns is to be printed, a case may also be caused where it is not possible to print the maintenance patterns at a predetermined timing under the influence of structural restriction or the like of the apparatus by updating the printing determination result in step S502 in FIG. 5 described later. However, there also exists a kind of maintenance operation to be executed ahead of time at an executable timing. For example, it is assumed that printing of the misfiring monitor pattern is rated as an important maintenance operation to be performed within a predetermined interval. The reason why importance is placed on misfiring monitor is that in the inkjet print head, since misfiring directly would lead to a defective printed image, its prevention is the matter of the highest priority.

Figure 7D:
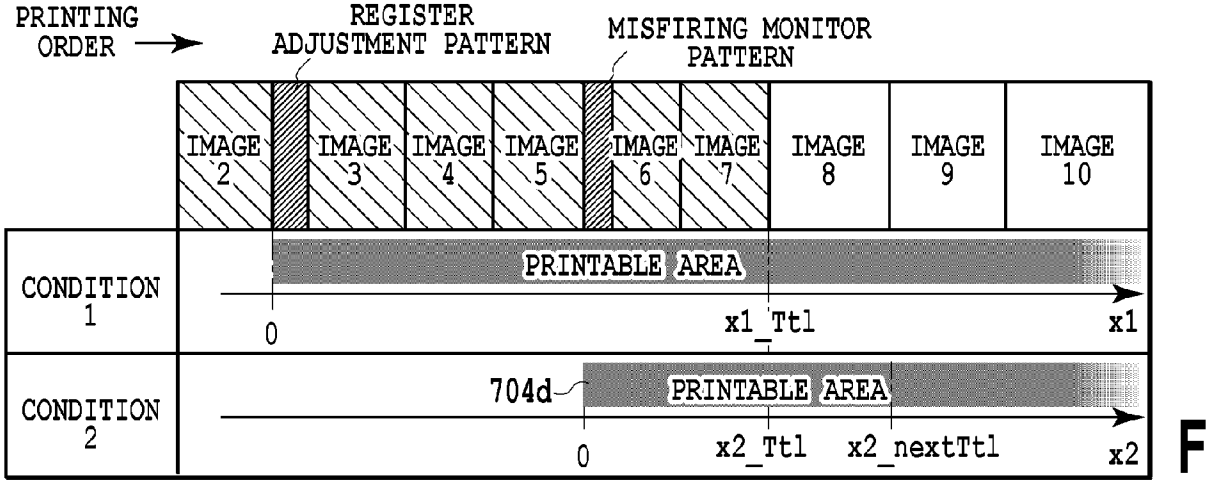

In this case, the printable area indicated by the band 704*b* in FIG. 7B is changed to a printable area with no upper limit indicated by a band 704*d* as illustrated in FIG. 7D. In accordance with this, the position of the number of lines x2_nextTtl which is updated at the time of printing the image 8 which is the image to be printed next falls within the printable area regardless of the size (the number of print lines) of the image 8. By the setting like this, it becomes possible to make reliably the printing determination result OK, without the evaluation in which the situation after printing the image to be printed next is taken into consideration. Therefore, also in the case where the plurality of maintenance patterns is to be printed, it becomes possible to perform required maintenance operations ahead of time.

In the above-mentioned manner, the processing for determining printing of each maintenance pattern between the image 7 and the image 8 in step S501 in FIG. 5 is terminated. Although the determination processing for two kinds of maintenance patterns of the register adjustment pattern and the misfiring monitor pattern is illustrated in FIG. 7A to FIG. 7D, the number of kinds of the maintenance patterns may be three by further including the preliminary ejection pattern. In addition, it is also applicable to determination processing for plural kinds of maintenance patterns including maintenance patterns other than the above. According to the printing determination processing in step S501, it becomes possible to perform printing at an appropriate timing which causes no mutual interference among the patterns even with the increase in the number of kinds of the maintenance patterns.

Next, updating (a second determination) of the printing determination result in step S502 is performed on the basis of the determination result (the first determination) of each maintenance pattern once determined in the printing determination processing in step S501 in FIG. 5.

Figure 8:
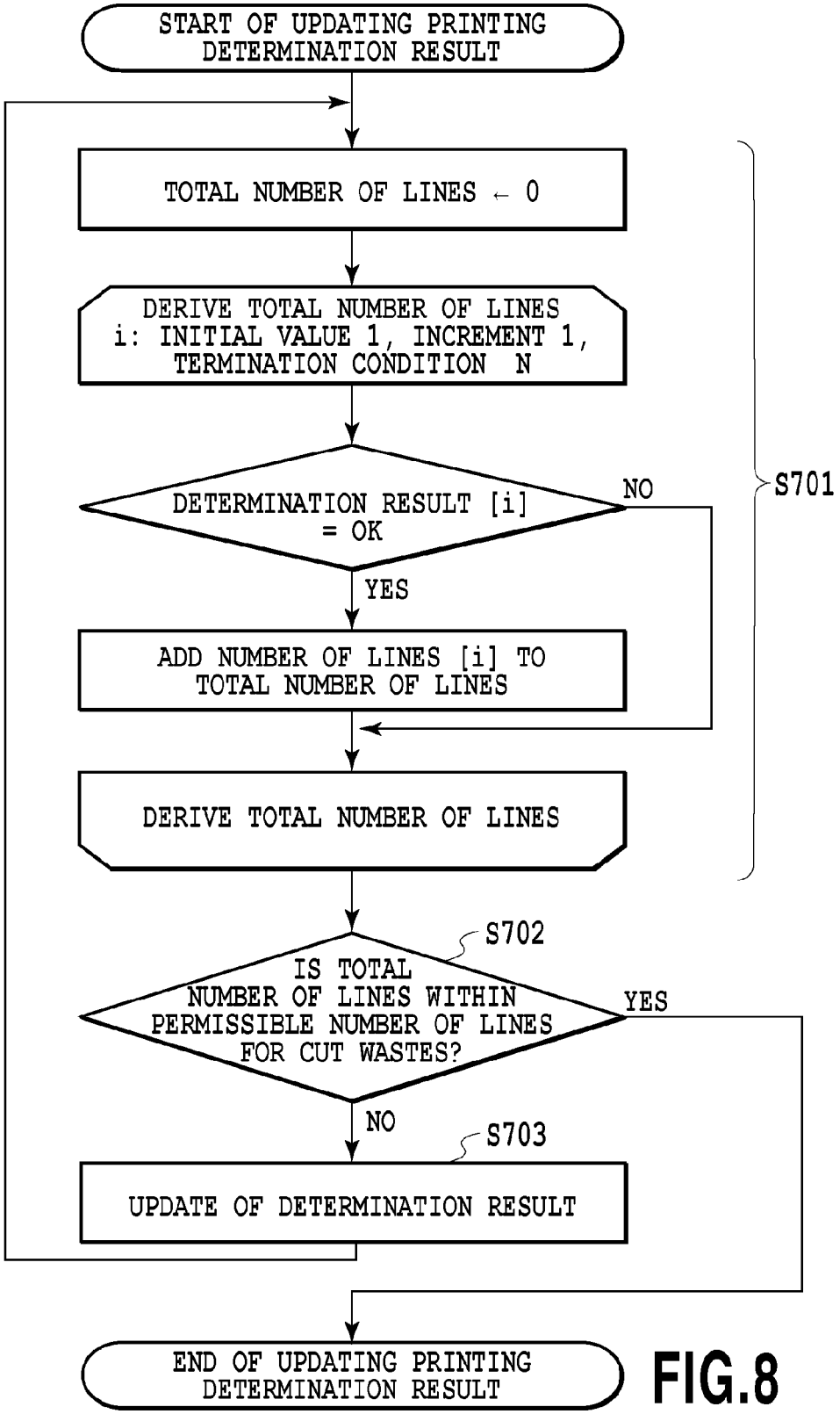
FIG. 8 is a flowchart illustrating details of updating of a printing determination result according to the embodiment of the present invention.

FIG. 8 is a flowchart illustrating details of updating of the printing determination result in step S502 in FIG. 5. In FIG. 8, a number of lines [*] indicates a number of lines required for printing a maintenance pattern as a *-th element in the number of elements N. A determination result [*] indicates a printing temporal determination result in the printing determination processing in step S501 with respect to the maintenance pattern as the *-th element in the number of elements N. A permissible number of lines for cut wastes in step S702 in FIG. 8 indicates a maximum number of lines for cut wastes that can be discarded into the cutter trash can 203 by the cutter unit 6, that is, a length in the printing order direction.

FIG. 9 is a table describing one example of updating of the printing determination result illustrated in FIG. 8. The number of kinds N of maintenance patterns as the number of elements is set to N=3, the maintenance pattern [1] is set to the register adjustment pattern, the maintenance pattern [2] is set to the misfiring monitor pattern, and a maintenance pattern [3] is set to the preliminary ejection pattern. The number of lines for printing the maintenance pattern [1] is the number of lines [1] set to 50, and the number of lines for printing the maintenance patterns [2] and [3] are respectively the number of lines [2] set to 500 and the number of lines [3] set to 200 similarly. In addition, the permissible number of lines for cut wastes is set to 600. The values of these numbers of lines are set for the convenience of description. Since the respective maintenance patterns are different depending on the purpose of maintenance, the number of lines to be used is also different accordingly.

In the present example, it is supposed that, as a result of temporal determination as to the presence or absence of printing in the printing determination processing in step S501 illustrated in FIG. 5 and FIGS. 6A and 6B, there is obtained a result of the misfiring monitor pattern and the preliminary ejection pattern being to be printed and the register adjustment pattern being not to be printed.

In step S701 including a series of processing illustrated in FIG. 8, the total number of lines for the maintenance patterns is calculated by summing up the respective numbers of lines of the misfiring monitor pattern and the preliminary ejection pattern which are scheduled to be printed from the result of the printing determination processing in step S501 in FIG. 5. Next, in step S702, it is determined whether or not the total number of lines calculated in step S701 is within the range of the permissible number of lines for cut wastes. In the present example, the total number of lines for the misfiring monitor pattern and the preliminary ejection pattern is 700, the permissible number of lines for cut wastes is 600 and the total number of lines exceeds the permissible number of lines for cut wastes. Therefore, the process proceeds to step S703, the determination result is updated, that is, the determination result is updated from OK to NG so as not to print the preliminary ejection pattern having low priority order, in the maintenance patterns, printing of which has been once determined. In the priority order of the maintenance patterns in the present example, the misfiring monitor pattern is the highest, the preliminary ejection pattern is the second highest and then the register adjustment pattern is the third highest. Therefore, in the present example, the determination result is updated so as not to print the preliminary ejection pattern having lower priority order, in the misfiring monitor pattern and the preliminary ejection pattern, printing of which has been determined.

However, in the present invention, the priority order of maintenance patterns is not limited to this and it is possible to determine it in accordance with the degree of importance of maintenance operations of various scales ranging from the one which brings added value to the apparatus, to the one which avoids a serious problem. In addition, it is also assumed that the degree of importance of each maintenance operation may be varied by giving priority to print quality, printing cost or the like depending on the intended purpose of each user. Therefore, as the priority order, through the use, as a reference, of a value that has been determined in advance from the degree of influence on the apparatus, there may be a configuration in which there is used a value that has been set by each user.

After the determination result has been updated in step S703, the process proceeds again to step S701 and the total number of lines is calculated. Here, since the pattern which is scheduled to be printed is only the misfiring monitor pattern having a higher priority order, the total number of lines is 500. Next, the process proceeds to step S702. Since the total number of lines=500 is lower than the permissible number of lines for cut wastes=600, the processing of updating the printing determination result is terminated as it is. In the above-mentioned manner, by updating the determination result so as not to print the preliminary ejection pattern, printing of the maintenance pattern becomes possible such that the length of the sheet on which the maintenance pattern is to be printed falls within the permissible number of lines for cut wastes.

From the above, updating of the printing determination result in step S502 in FIG. 5 is terminated, and the maintenance patterns to be printed in units of non-image parts are determined.

Although, in FIG. 9, the determination processing for three kinds of maintenance patterns of the register adjustment pattern, the misfiring monitor pattern and the preliminary ejection pattern is illustrated, the maintenance patterns may further include other kinds of maintenance patterns and the determination processing is applicable to the plural kinds of maintenance patterns. As other kinds, there exist position adjustment patterns other than the register adjustment pattern. As the number of kinds of the maintenance patterns becomes larger, the number of maintenance operations which are executable during printing becomes larger. Therefore, although the print quality is improved, structural restriction on the apparatus such as restriction on the permissible number of lines for cut wastes may occur due to an increase in the number of lines for non-image parts. According to the present embodiment, it becomes possible to print as many printable maintenance patterns as possible, starting from the one having higher priority order while meeting such restriction.

In the above-mentioned embodiment, printing determination control was made using the number of lines such that the respective maintenance patterns are printed leaving a space for analysis. However, in the present invention, there may be used, as the criterion, a time elapsed from the previous printing of each maintenance pattern, a frequency of ejecting ink from the print head or an accumulated ejected ink amount, in place of the number of lines. The plurality of maintaining operations is executed using the non-image areas with respective inherent frequencies or cycles regardless of which determination criterion is adapted. Note that, here, the inherent frequency or cycle is not necessarily defined so as to come at regular intervals or time intervals and includes some fluctuation. Then, the schedule is set such that one maintenance operation and another maintenance operation are not performed at the same non-image area. In addition, the present invention is not limited to the above-mentioned embodiment and may be modified (including application to other embodiments, combination with other embodiments and the like) in a variety of ways on the basis of the spirit of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-145308 filed Jun. 28, 2012, which is hereby incorporated by reference herein in its entirety.

What is claimed is:

1. A method for printing on a continuous sheet with an inkjet head, the method comprising:

printing a plurality of images in sequence;

performing a first maintenance operation by printing a first maintenance pattern on an intermediate area, an intermediate area being defined as an area located between one of the plurality of images and a next one of the plurality of images; and performing a second maintenance operation by printing a second maintenance pattern on an intermediate area;

wherein the first maintenance is performed under a first execution condition and the second maintenance operation is performed under a second execution condition which is different from the first execution condition, and wherein performing the first maintenance operation and the second maintenance operation in a same intermediate area is restricted.

2. The method according to claim 1, wherein in a case where it is determined that the first maintenance operation and the second maintenance operation are scheduled to be performed in a same intermediate area from the respective first and second execution conditions of the first maintenance operation and the second maintenance operation, the first maintenance operation is preferentially performed at a first intermediate area and the second maintenance operation is performed at a second intermediate area located between the next image of the plurality of images and the image after the next image of the plurality of images.

3. The method according to claim 2, wherein the first maintenance operation includes at least one of printing of a preliminary ejection pattern and a misfiring monitor pattern and the second maintenance operation includes printing of a register adjustment pattern.

4. The method according to claim 1, wherein the first maintenance operation and the second maintenance operation are different in execution cycles.

5. The method according to claim 1, wherein both the first maintenance operation and the second maintenance operation include analyzing a printed maintenance pattern.

6. A method for printing on a continuous sheet with an inkjet head, the method comprising:

printing a plurality of images in sequences;

performing a first maintenance operation by printing a first maintenance pattern on an intermediate area, an intermediate area being defined as an area located between one of the plurality of images and a next one of the plurality of images;

performing a second maintenance operation having an execution condition different from that of the first maintenance operation by printing a second maintenance pattern on an intermediate area; and determining, based on a state of processing of the first maintenance operation, whether the second maintenance operation is to be performed in an intermediate area, wherein the second maintenance operation is performed based on a result of the determining.

7. The method according to claim 6, wherein the first maintenance operation is longer than the second maintenance operation in terms of a pattern to be printed on the continuous sheet in maintenance.

8. The method according to claim 7, wherein the first maintenance operation includes printing of a preliminary ejection pattern or a misfiring monitor pattern and the second maintenance operation includes printing of a register adjustment pattern.

9. The method according to claim 6, wherein the first maintenance operation and the second maintenance operation are different in execution cycles.

10. The method according to claim 6, wherein both the first maintenance operation and the second maintenance operation include analyzing a printed maintenance pattern.

11. The method according to claim 10, wherein, determination is made not to perform another maintenance operation when one maintenance operation is being analyzed even when an execution condition for the other maintenance operation occurs.

12. An apparatus for printing on a continuous sheet with an inkjet head, the apparatus comprising:

a control unit configured to control printing of a plurality of images in sequence, performing a first maintenance operation by printing a first maintenance pattern on an intermediate area, an intermediate area being defined as an area located between one of the plurality of images and a next one of the plurality of images, and performing a second maintenance operation by printing a second maintenance pattern on an intermediate area, wherein the first maintenance operation is performed under a first execution condition and the second maintenance operation is performed under a second execution condition which is different from the first execution condition, and wherein performing the first maintenance operation and the second maintenance operation in a same intermediate area is restricted.

13. The apparatus according to claim 12, wherein the first maintenance operation and the second maintenance operation are different in execution cycles.

14. An apparatus for printing on a continuous sheet with an inkjet head, the apparatus comprising:

a control unit configured to control printing of a plurality of images in sequence, performing a first maintenance operation by printing a first maintenance pattern on an intermediate area, an intermediate area being defined as an area located between one of the images and a next one of the images, performing a second maintenance operation by printing a second maintenance pattern on an intermediate area, and determining, based on a state of processing of the first maintenance operation, whether the second maintenance operation is to be performed in an intermediate area, wherein the second maintenance operation is performed based on a result of the determining.

15. The apparatus according to claim 14, wherein the first maintenance operation and the second maintenance operation are different in execution cycles.

* * * * *